United States Patent [19]

Allmendinger

[11] 4,061,507

[45] Dec. 6, 1977

[54] WRENCH AND METHOD OF MAKING THE SAME

[75] Inventor: Norbert Allmendinger, Willoughby Hills, Ohio

[73] Assignee: Richmond Industries, Inc., Willoughby, Ohio

[21] Appl. No.: 700,190

[22] Filed: June 28, 1976

[51] Int. Cl.[2] ..... C21D 1/06; C21D 9/00

[52] U.S. Cl. ..... 148/12 R; 72/326; 76/114; 113/116 BB; 148/12 E; 148/131

[58] Field of Search ..... 76/114; 113/116 BB; 148/12 R, 12 E, 12.1, 131; 72/326, 330

[56] References Cited

U.S. PATENT DOCUMENTS

| | | | |
|---|---|---|---|
| 3,823,596 | 7/1974 | Elder et al. | 113/116 BB |
| 3,852,870 | 12/1974 | Elliot | 113/116 BB |

FOREIGN PATENT DOCUMENTS

| | | | |
|---|---|---|---|
| 614,319 | 2/1961 | Canada | 113/116 BB |

*Primary Examiner*—W. Stallard

[57] ABSTRACT

An improved high strength wrench is stamped from a strip of a heat hardenable and relatively strong metal, such as stainless steel. The wrench is of the open-end type and has jaws with operating surfaces which, due to the hardness of the metal from which the wrench is stamped, maintain their original configuration even after the wrench has been utilized for an extended period of time. To promote the accurate formation of the operating surfaces of the jaws of the wrench, they are initially formed to a size which approximates their final size and configuration. The operating surfaces are then accurately trimmed to their final size and configuration by a shaving operation. During this shaving operation, a section of metal extending between the outer ends of the jaws of the wrench holds the jaws of the wrench against movement relative to each other. The section of metal extending between the outer ends of the jaws of the wrench is sheared off to provide an open-ended wrench having jaws with accurately formed operating surfaces to engage a nut or other article.

5 Claims, 5 Drawing Figures

46
3
3
38
52
50
56
62
66
64
68
60
84
86
88
92
94
96
132
128
134
130
120
142
144
138
146

WRENCH AND METHOD OF MAKING THE SAME

BACKGROUND OF THE INVENTION

This invention relates to a new and improved wrench which is stamped from a strip of metal and has a relatively high strength and long operating life and to the method by which the wrench is made with accurately formed operating surfaces for engaging a nut or other article.

Relatively low quality wrenches are commonly stamped out of a sheet of low carbon steel. Although these wrenches are relatively inexpensive to fabricate, the operating surfaces of the wrench are soon deformed by use of the wrench so that it has to be discarded. In an effort to overcome the poor durability and quality of conventional stamped wrenches, it has been suggested that the wrench be provided with a corrugated construction in the manner disclosed in U.S. Pat. No. 3,298,260. Of course, forming the wrench with a corrugated construction increases the cost of fabricating the wrench and does not enhance the hardness and durability of the operating surfaces on the jaws of the wrench.

In order to provide a stamped wrench having jaws with relatively hard and durable operating surfaces, it has been suggested that the wrench be provided with a laminated construction with each of the laminations being formed of stainless steel in the manner disclosed in U.S. Pat. No. 3,709,073. Although the resulting wrench does have jaws with operating surfaces which are relatively hard and durable, the cost of forming this wrench is increased by the fact that the laminations must be interconnected by welds which extend along the entire outer peripheral edge of the laminations. Of course, the making of these welds increases the cost of fabricating a wrench, particularly when the laminations are made out of stainless steel which is, to some extent at least, difficult to weld.

Stamping operations have been utilized to sequentially form many different types of objects in the manner disclosed in U.S. Patent Nos. 3,442,159 and 3,531,861. However, all these prior art patents fail to disclose a method of forming a high quality stamped wrench which is integrally formed of one piece and has jaws with operating surfaces which are accurately formed and are relatively hard to withstand and forces applied to these operating surfaces during use of the wrench.

SUMMARY OF THE PRESENT INVENTION

The present invention provides a new and improved high quality stamped wrench. The wrench is integrally formed of a single piece of metal which is stamped out of a strip. In order to provide the jaws of the wrench with relatively hard durable operating surfaces, the wrench is stamped out of a stainless steel strip. In order to provide the wrench with the requisite strength and handling characteristics, the stainless steel strip from which the wrench is stamped has a thickness of approximately three-sixteenths of an inch. Of course, strips of different thicknesses could be utilized if desired. Although a particularly satisfactory wrench is obtained by utilizing stainless steel, it is contemplated that other metals, such as beryllium copper, could be utilized.

In accordance with a feature of the present invention, the wrench is stamped with jaws having accurately formed operating surfaces. This is accomplished by piercing a metal strip to form the operating surfaces of the jaws to a size and configuration which approximates their final size and configuration. The outer ends of the jaws are interconnected by the metal of the strip to hold the operating surfaces on the jaws against movement relative to each other. The pierced hole in the sheet metal strip is then shaved to accurately form the operating surfaces of the jaws to their final size and configuration while the operating surfaces are held against movement relative to each other by a section of metal extending between the outer end portions of the jaws. This section of metal is separated from the end portions of the jaws when the operating surfaces have been accurately formed. Although it is preferred to form the operating surfaces of the jaws of the wrench of sequential shearing operations to remove metal from a strip, it is contemplated that under certain circumstances it may be desirable to form the jaws to their final configuration in a different manner.

Accordingly, it is an object of this invention to provide a new and improved high quality wrench which is stamped out of a strip of material and has jaws with accurately formed and relatively hard operating surfaces to enhance the durability of the wrench.

Another object of this invention is to provide a new and improved method of forming a wrench which has a pair of spaced apart jaws with accurately formed operating surfaces and wherein the method includes the steps of forming the jaws of the wrench to a size and configuration approximately their final size and configuration by shearing a portion of a strip of metal and subsequently forming the jaws of the wrench to their final size and configuration while holding the operating surfaces on the jaws of the wrench against movement relative to each other with a section of metal extending between outer end portions of the jaws.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figures 1, 2:
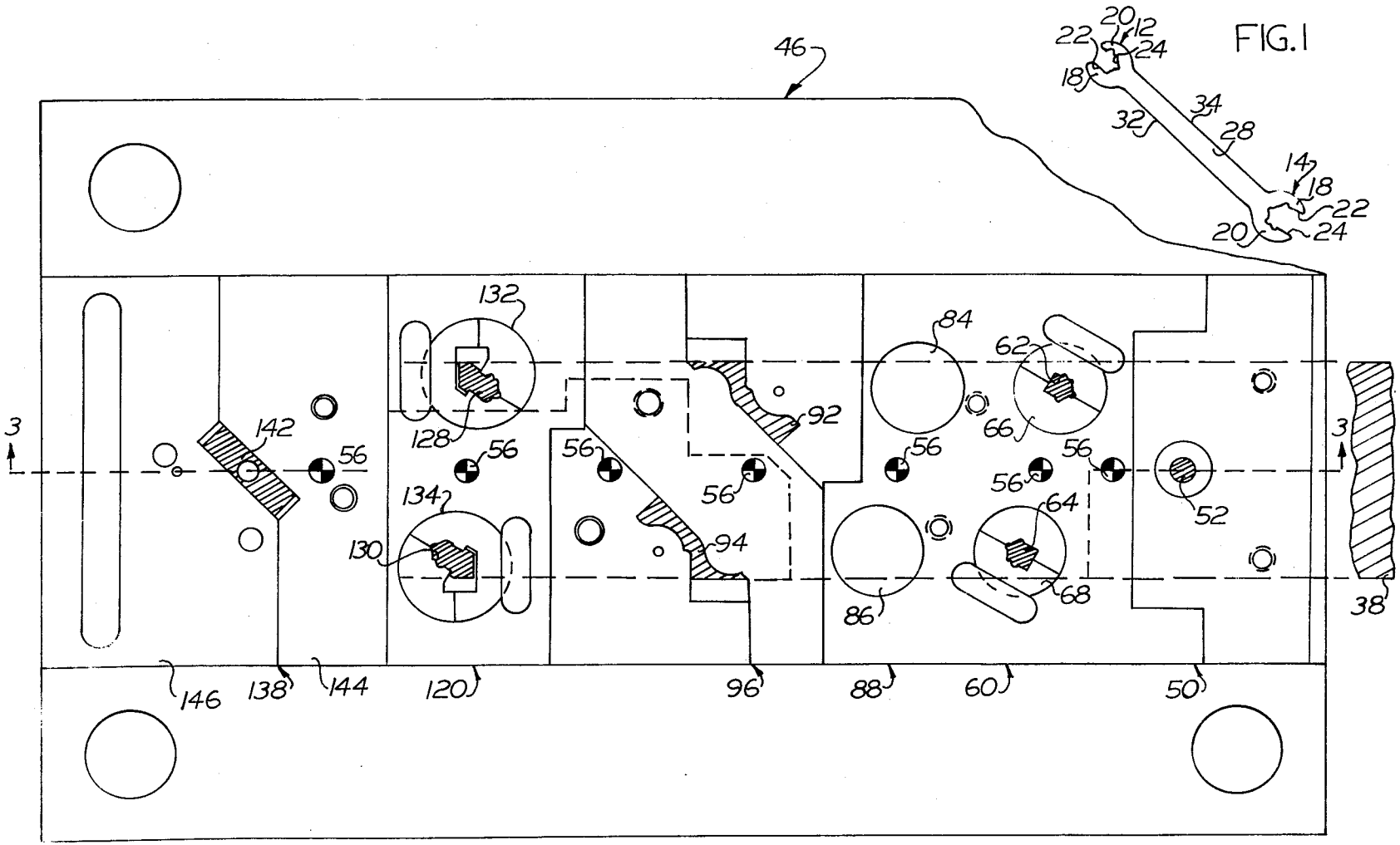
FIG. 1 is a plan view of an open-ended wrench constructed in accordance with the present invention.
FIG. 2 is a plan view of the lower shoe of a progressive die utilized to form the wrench of FIG. 1.

Although other types of wrenches could be made in accordance with the present invention, a double open-end wrench 10 constructed in accordance with the present invention is illustrated in FIG. 1. The wrench 10 has a pair of head end portions 12 and 14. Each of the head end portions 12 and 14 is provided with a pair of spaced apart jaws 18 and 20 having accurately formed and relatively hard operating surfaces 22 and 24 for engaging an article such as a nut. Although it is contemplated that the operating surfaces 20 and 22 could have many different configurations, in the illustrated embodiment of the invention the operating surfaces 20 and 22 have a configuration similar to that disclosed in U.S. Pat. No. 3,762,244.

Head ends 12 and 14 of the wrench 10 are interconnected by a handle portion 28. The head ends 12 and 14 and handle portion 28 are integrally formed with each other and have continuous flat major side surfaces which extend parallel to each other throughout the length of the wrench 10. The major side surfaces of the wrench are interconnected by minor side surfaces 32 and 34 having a uniform width throughout the length of the wrench 10. In one specific embodiment of the invention, the side surfaces 32 and 34 have a width of approximately three-sixteenths of an inch. Of course, the width of the side surfaces may vary depending upon the strength requirements of the wrench 10.

In accordance with a feature of the present invention, the wrench 10 is formed of stainless steel. By making the wrench of stainless steel, the operating surfaces 22 and 24 are relatively hard so that the wrench can be utilized for an extended period of time without deforming the operating surfaces. In one specific preferred embodiment of the invention, the wrench 10 was formed of a 410 stainless steel. Of course, other stainless steels could be used if desired. In fact, it is contemplated that the wrench 10 may, if desired, be formed of beryllium copper.

The wrench 10 is stamped or sheared as one piece from a single strip 38 (see FIG. 2) of metal. In the present instance, the strip 38 is formed of stainless steel and has a thickness of approximately three-sixteenths of an inch. The stainless steel strip 38 has flat parallel major side surfaces which form the major side surfaces of the handle 28 and head end portions 12 and 14 of the wrench 10.

Figure 3:
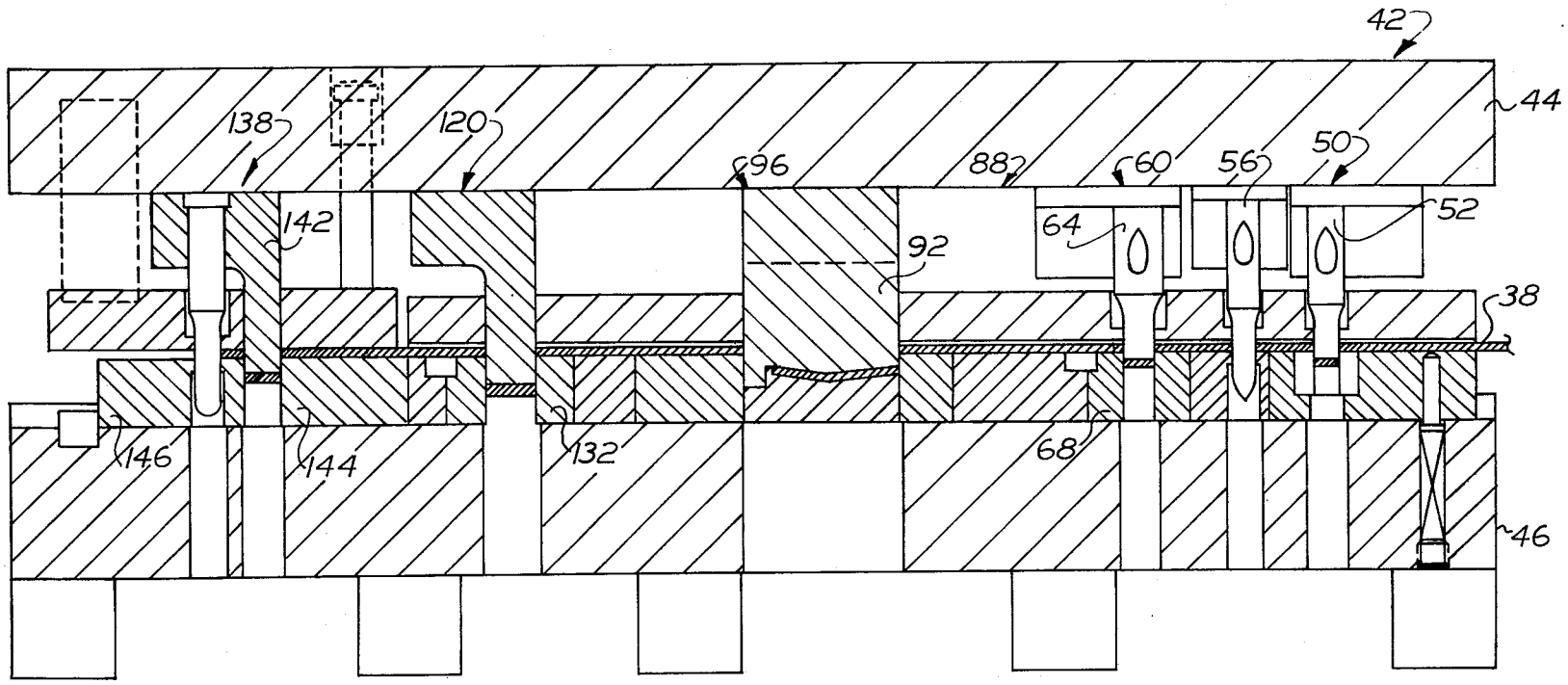
FIG. 3 is a sectional view, taken generally along the line 3—3 of FIG. 2, illustrating the construction of the progressive die.
Figure 4:
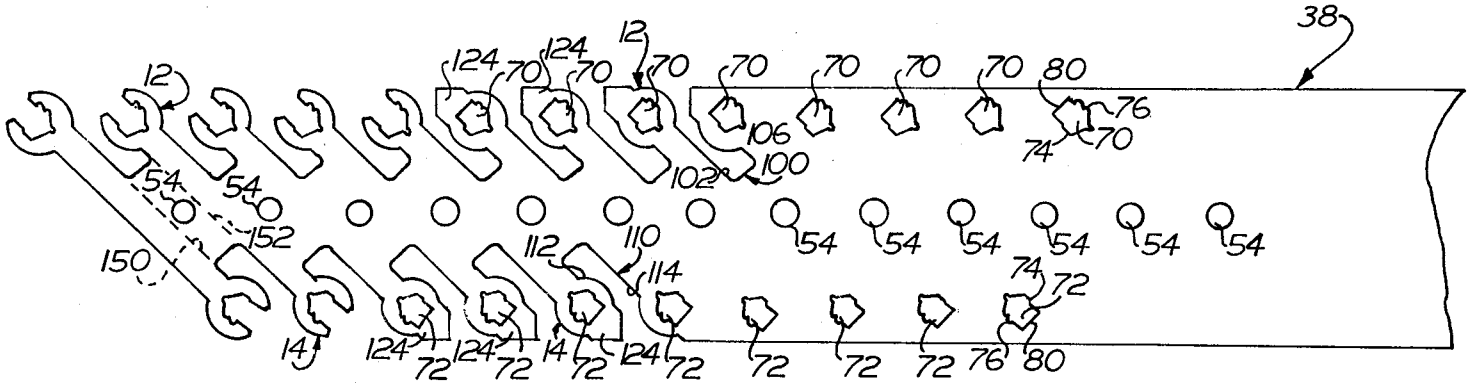
FIG. 4 is a plan view of the strip development for the formation of a wrench with the progressive die of FIGS. 2 and 3.

The wrench 10 is formed by utilizing a progressive die 42 (see FIG. 3) having an upper shoe 44 on which suitable punches and pilots are located. A lower shoe 46 (see FIGS. 2 and 3) is provided with dies which cooperate with the punches on the upper shoe in a known manner to sequentially form a plurality of wrenches 10 in the strip 38. The manner in which the strip is sequentially sheared at each one of a plurality of work stations in the progressive die of FIGS. 2 and 3 is illustrated in FIG. 4. At the first work station 50 (see FIGS. 2 and 3) of the progressive die 42, a punch 52 pierces a circular locating or reference hole 54 in the strip 38. As the strip 38 moves through the progressive die 46, the locating holes 54 are engaged by pilots 56 (see FIGS. 2 and 3) to position the strip relative to work stations in the progressive die.

At a second work station 60 in the progressive die 42, a pair of punches 62 and 64 (FIG. 2) cooperate with split die bushings 66 and 68 to pierce holes 70 and 72 (FIG. 4) in the strip 38. The holes 70 and 72 have a pair of side surfaces with a configuration corresponding to the configuration of the operating surfaces 22 and 24 of the wrench 10. However, the side surfaces 74 and 76 are slightly closer together than the operating surfaces 22 and 24 of the wrench 10 to enable the side surfaces 74 and 76 of the holes 70 and 72 to be subsequently accurately formed to a desired final size and configuration. It should be noted that the two side surfaces 74 and 76 are interconnected by a straight side surface 80 of the holes 70 and 72. Thus, the two side surfaces 74 and 76 are held against movement toward or away from each other by the metal on which the side surface 80 is disposed.

A pair of plugs 84 and 86 are provided at an idle station 88 of the progressive die 42.

A pair of notching punches 92 and 94 are provided at a next succeeding work station 96. A notching punch 92 shears away the metal strip to form the trailing side of the head portion 12 of one wrench and the leading side of the head portion 12 of the next succeeding wrench. In addition, the punch 92 forms a portion of the handles of the two wrenches. Thus, the notch 100 (see FIG. 4) formed by the punch 92 has a side surface 102 with a configuration corresponding to the trailing side of the head portion of a wrench and the trailing side of the handle of the same wrench. The notch 100 has an opposite side surface 106 with a configuration corresponding to a portion of the leading side of the handle of a next succeeding wrench and the leading side of the head portion 12 of the wrench.

Similarly, the punch 94 forms a notch 110 having a side portion 112 of a configuration corresponding to the configuration of a trailing side of a head portion 14 of a wrench. The notch 110 has an opposite side surface 114 with a configuration corresponding to the configuration of a leading side of a next succeeding wrench. It should be noted that the two sides 112 and 114 also define a portion of the handle 28 of the wrench 10.

The holes 70 and 72 are shaved at a next succeeding work station 120 to accurately form the operating surfaces 22 and 24 on the jaws 18 and 20 of the wrench. The punches 62 and 64 at the work station 60 (see FIG. 2) pierced holes having side surfaces 74 and 76 which were disposed closer together than the desired distance between the operating surfaces 22 and 24 of the jaws of the wrench. Therefore, the jaws of the wrench are sightly oversized before they reach the work station 120 of the progressive die.

Figure 5:
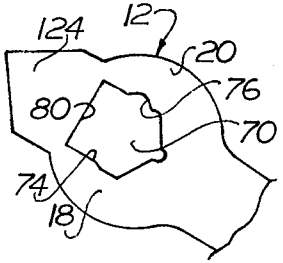
FIG. 5 is a fragmentary plan view illustrating the manner in which outer end portions of a pair of jaws on a wrench are held against movement to each other by a section of metal.

The outer end portions of the jaws 18 and 20 are interconnected by a section of metal 124 (see FIG. 5) upon which the side surface 80 of the hole 70 is formed. The metal section 124 holds the jaws 18 and 20 against sidewise movement relative to each other under the influence of forces applied to the strip 38 by the punch 92 at the work station 96. In addition, the metal section 124 holds the jaws 18 and 20 against movement relative to each other during the shaving operation in which a very small amount of metal is sheared away to accurately form the operating surfaces 22 and 24 on the jaws.

In the progressive die 42 illustrated herein, the metal section 124 is removed or separated from the ends of the jaws 18 and 20 simultaneously with the accurate forming of the operating surfaces 22 and 24 of the jaws. Even though the metal section 124 is sheared away as a small amount of metal is sheared off of the side surfaces 74 and 76 of the hole 70, the metal section is effective to hold the jaws and side surfaces formed thereon against movement relative to each other during the shaving operation. This is because the metal section 124 is sheared off from the ends of the jaws by the same punch that is utilized to shave or trim the jaws to accurately form the operating surfaces 22 and 24. Thus, midway through a shaving or trimming stroke to accurately form the operating surfaces 22 and 24, the shearing stroke for severing the metal section 124 from the ends of the jaws is also at its midway point. Therefore, the metal section 124 remains connected with the jaws 18 and 20 to hold them against relative movement until the shaving or trimming stroke is completed.

A pair of punches 128 and 130 cooperate with split dies 132 and 134 at the work station 120 (see FIG. 2) to shave the opposite side surfaces 74 and 76 of the holes 70 and 72 to accurately form the operating surfaces 22 and 24 on the wrench 10. In addition, the punches 128 and 130 sever the connecting metal section 124 from the outer end portions of the jaws 18 and 20. If desired, a separate punch could be utilized to sever the metal section 124 from the ends of the jaws 18 and 20 at a succeeding work station. Since the punches 128 and 130 trim only a relatively small amount of metal from the surfaces 74 and 76 of the holes 70 and 72, the operating surfaces 22 and 24 and the jaws of the wrench 18 and 20 are accurately formed.

Since the strip 38 is formed of stainless steel, in one specific instance a 410 stainless steel, the metal of the strip cannot be smoothly sheared away by the punches 62 and 64 to accurately form the side surfaces 74 and 76 of the holes 70 and 72. The metal of the strip tends to flow or be drawn under the influence of the forces applied to the strip by the punches 62 and 64. In addition, due to the inherent characteristics of stainless steel, the metal does not shear cleanly away under the influence of the punches. Therefore, if the step of shaving the side surfaces 74 and 76 of the holes 70 and 72 where omitted, the operating surfaces on the jaws of the resulting wrench would be inaccurately formed and would not have the required dimensional accuracy to provide a smooth acting wrench.

Once the jaws 18 and 20 at opposite ends of a wrench have been formed, the wrench is severed from the strip at a work station 138. Thus, a punch 142 cooperates with a pair of die blocks 144 and 146 to cut away a generally rectangular piece of material from a trailing side of one wrench and a leading side of a next succedding wrench on the strip. The strip is sheared along the lines indicated in dashed lines at 150 and 152 in FIG. 4 to cut off the finished wrench from the end of the strip 38.

As the strip 38 is advanced through the progressive die 42, a plurality of wrenches are sequentially formed in the manner previously explained. Since these wrenches have all been stamped from a strip of 410 stainless steel, each of the wrenches has an integral construction with the grain of the metal aligned rather than distorted as in the case of a forged wrench. After the wrenches have been stamped from the sheet 38, they are hardened by being heat treated in a known manner and then polished to have an aesthetically pleasing finish. Although in the present instance the wrenches are made of stainless steel, it is contemplated that the wrenches will be formed of other materials, such as beryllium copper.

In view of the foregoing description, it is apparent that the present invention provides a new and improved high quality stamped wrench 10. The wrench 10 is integrally formed of a single piece of metal which is stamped out of a strip 38. In order to provide the jaws 18 and 20 of the wrench with relatively hard durable operating surfaces, the wrench is stamped out of a stainless steel strip. In order to provide the wrench with the requisite strength and handling characteristics, the stainless steel strip 38 from which the wrench was stamped had a thickness of approximately three-sixteenths of an inch. Of course, strips of different thicknesses could be utilized if desired. Although a particularly satisfactory wrench is obtained by utilizing stainless steel, it is contemplated that other metals, such as beryllium copper, could be utilized.

In accordance with a feature of the present invention, the wrench 10 is stamped with jaws 18 and 20 having accurately formed operating surfaces 22 and 24. This is accomplished by piercing the metal strip 38 at the work station 60 to form the operating surfaces 74 and 76 on the jaws to a size and configuration which approximates their final size and configuration. The outer ends of the jaws 18 and 20 are interconnected by the metal of the strip 38 to hold the operating surfaces 22 and 24 on the jaws against movement relative to each other. The pierced hole 70 in the sheet metal strip 38 is then shaved at the work station 120 to accurately form the operating surfaces 22 and 24 of the jaws 18 and 20 to their final size and configuration while the operating surfaces are held against movement relative to each other by a metal section 124 extending between the outer end portions of the jaws. The metal section 124 is separated from the end portions of the jaws 18 and 20 when the operating surfaces 22 and 24 have been accurately formed. Although it is preferred to form the operating surfaces 22 and 24 of the jaws of the wrench by sequential shearing operations to remove metal from a strip, it is contemplated that under certain circumstances it may be desirable to form the jaws to their final configuration in a different manner.

Having described one specific preferred embodiment of the invention, the following is claimed:

1. A method of sequentially forming a plurality of open-ended wrenches each of which has a pair of spaced apart jaws with accurately formed operating surfaces extending inwardly from outer end portions of the jaws, said method comprising the steps of providing a strip of metal, sequentially forming jaws of a plurality of wrenches to a size and configuration approximating but larger than their final size and configuration by shearing portions of the strip of metal, said step of sequentially forming the jaws of a plurality of wrenches to a size and configuration approximately their final size and configuration including the step of leaving a section of metal extending between outer end portions of the jaws of each of the wrenches, sequentially forming the jaws of the wrenches to their final size and configuration, said step of forming the jaws of the wrenches to their final size and configuration including the step of shearing metal to form the jaw operating surfaces of each of the wrenches while holding the jaws against movement relative to each other with the section of metal extending between the outer end portions of the jaws, and separating from each of the wrenches the section of metal extending between the outer end portions of the jaws.

2. A method as set forth in claim 1 further including the step of hardening the operating surfaces of the jaws of the wrenches by heat treating the wrenches.

3. A method as set forth in claim 1 wherein said step of providing a strip of metal includes the step of providing a strip of stainless steel.

4. A method as set forth in claim 3 wherein said step of providing a strip of stainless steel further includes the step of providing a strip of stainless steel having a thickness of at least approximately 3/16 of an inch.

5. A method of sequentially forming a plurality of open-ended wrenches each of which has a pair of spaced apart jaws with accurately formed operating surfaces extending inwardly from outer end portions of the jaws, said method comprising the steps of providing a strip of metal, sequentially piercing the strip of metal at spaced apart location to form holes in the strip of metal, each of the holes formed by performing said step of piercing the strip of metal having a pair of side surface areas approximately the final size and configuration of the operating surfaces of the jaws of wrench but disposed slightly closer together than the operating surfaces of the jaws of the wrench, sequentially shaving the holes formed by said piercing operation to accurately form the operating surfaces of the jaws of each of the wrenches, and sequentially shearing the metal strip to form the outer side edges of the wrenches and to open the holes formed by said having steps to form the open ends of the wrenches.

* * * * *

UNITED STATES PATENT AND TRADEMARK OFFICE

CERTIFICATE OF CORRECTION

PATENT NO. : 4,061,507
DATED : December 6, 1977
INVENTOR(S) : Norbert Allmendinger It is certified that error appears in the above-identified patent and that said Letters Patent are hereby corrected as shown below:

Column 8, line 5, change "having" to --shaving--.

Signed and Sealed this

Sixteenth Day of May 1978

[SEAL]

*Attest:*

RUTH C. MASON
*Attesting Officer*

LUTRELLE F. PARKER
*Acting Commissioner of Patents and Trademarks*